US007220048B2

(12) United States Patent
Kohlgrüber et al.

(10) Patent No.: US 7,220,048 B2
(45) Date of Patent: May 22, 2007

(54) MIXER/HEAT EXCHANGER

(75) Inventors: Klemens Kohlgrüber, Kürten (DE); Peter Jähn, Leverkusen (DE)

(73) Assignee: Bayer Aktiengesellschaft, Leverkusen (DE)

( * ) Notice: Subject to any disclaimer, the term of this patent is extended or adjusted under 35 U.S.C. 154(b) by 151 days.

(21) Appl. No.: 10/622,625

(22) Filed: Jul. 18, 2003

(65) Prior Publication Data

US 2004/0085853 A1 May 6, 2004

(30) Foreign Application Priority Data

Jul. 24, 2002 (DE) ..... 102 33 506

(51) Int. Cl.
*B01F 15/06* (2006.01)

(52) U.S. Cl. ..... 366/147; 366/337; 165/172; 165/181

(58) Field of Classification Search ..... 366/146, 366/147, 336, 337; 165/172, 174, 181–184, 165/164, 159
See application file for complete search history.

(56) References Cited

U.S. PATENT DOCUMENTS 1,921,927 A * 8/1933 Jones et al. ..... 165/183
2,322,341 A * 6/1943 Booth ..... 165/131
3,111,168 A * 11/1963 Huet ..... 165/165
3,916,989 A * 11/1975 Harada et al. ..... 165/151
4,314,606 A 2/1982 Müller et al. ..... 165/163
4,877,087 A * 10/1989 Hill ..... 165/181
5,472,047 A * 12/1995 Welkey ..... 165/172
RE36,969 E * 11/2000 Streiff et al. ..... 366/173.1
6,412,975 B1 7/2002 Schuchardt et al. ..... 366/337

FOREIGN PATENT DOCUMENTS

| | | | |
|---|---|---|---|
| BE | 465 451 A | | 6/1946 |
| DE | 28 39 564 | | 3/1980 |
| EP | 1 067 352 A1 | | 1/2001 |
| GB | 521548 | * | 5/1940 |
| GB | 569000 | * | 4/1945 |

* cited by examiner

*Primary Examiner*—David Sorkin
(74) *Attorney, Agent, or Firm*—Norris McLaughlin & Marcus PA

(57) ABSTRACT

A combination static mixer and heat exchanger having heat exchanger tubes (1) which are provided over their circumference with fins (2*a*, 2*b*) which have a static mixing effect.

21 Claims, 8 Drawing Sheets

MIXER/HEAT EXCHANGER

The invention relates to a combination of static mixer and heat exchanger for the process engineering treatment of thermally sensitive viscous media, comprising a plurality of tubes which are arranged in parallel next to, above or offset with respect to one another, are positioned transversely, at an angle, preferably of 90°, with respect to the direction of flow of the product, in a housing and to which media flow. On their external diameter, the tubes have raised, radially arranged fins or curved fins which are arranged axially offset with respect to the tube axis and are offset with respect to one another on the tube axis. The raised fins are arranged in such a way that, particularly in the case of viscous and highly viscous substances and substance mixtures, a good mixing action is produced and, at the same time, the significantly increased tube external surface area (i.e., as increased by the fins) for the first time allows rapid temperature control which is gentle on the product.

BACKGROUND OF THE INVENTION

The rapid, uniform and gentle controlling of the temperature of viscous and highly viscous products, e.g. polymer melts, is only achieved to an insufficient extent using the known static mixer systems described below. Only the outer temperature-controlled housing or tube wall is available as a direct heating surface for these purposes. To control the temperature of a product, the latter is passed a number of times through the known static mixers from the center of the housing or tube to the temperature-controlled housing wall, so that the desired product temperature is reached over an increasing length of the heating section. Temperature-control objectives of this type require long temperature-controlled mixing distances, on account of the low thermal conductivity of most organic substances, leading to a long residence time and a high pressure loss and therefore to damage to viscous substances (>1 mPa·s) with a laminar flow velocity, in particular those with a temperature-sensitive character. An additional drawback of the long mixing distances is the high design-related investment costs involved with such systems. Drawbacks such as the low mechanical stability and high pressure losses of known static mixers lead to the need for large cross sections of flow, which in turn make temperature control more difficult.

A slight improvement in terms of temperature-control objectives is achieved if known static mixers are pressed or rolled into pipelines or into housings. This results in limited metallic contact between the heated inner housing wall and the small outer cross-sectional areas of the metallic static mixers. However, the static mixer which has been drawn or rolled in can only form an inadequate contact surface with the temperature-controlled housing wall. Experience has shown that the contact surfaces are not formed completely, and consequently there are always gaps with respect to the inner housing wall. On account of higher thermal conduction properties of the metallic mixing fins, small amounts of heat are passed radially through these narrow gaps into the flow region of the static mixer. This method allows a slight improvement only with very small housing or tube diameters, since the conduction of heat to the center of the static mixer or the housing is limited by the small, incompletely formed contact surfaces. Furthermore, these gaps represent "dead areas", which contribute to the formation of specks, for example in polymer melts. These specks (impurities) reduce the quality of the products sold (e.g. thermoplastics).

Known static mixers which are soldered into housings or pipelines have slightly better temperature-control properties. The soldering operation requires an accurately prepared housing or pipe and a static mixer which has been machined on its external diameter, so that a good and complete soldered joint can be produced. The mechanical preparations which have to be carried out on the parts to be soldered are complex and cost-intensive. If soldering is successful, static mixers which are soldered in have a good contact surface with respect to the inner temperature-controlled housing wall. On account of the geometric structure of the static mixers, however, the contact surface with respect to the heated housing surface is very small, and consequently only a slightly higher temperature-control capacity with respect to the product flow is possible. The increase in the size of the temperature-controlled surface area compared to the static mixers which are rolled in is not significantly higher, and consequently mixing distances with soldered static mixers cannot be shortened significantly. On account of the limited overall size of soldering furnaces and on account of the distortion caused to the tubes during soldering, the soldering process is only possible for a short length of tube (generally <2 m).

Moreover, the solder used means that additional corrosion problems often occur and have to be taken into account during use of mixers of this type, in order to ensure that, for example, the purity and quality of a product are not adversely affected by impurities resulting from corrosion.

Furthermore, tubes with outer thin sheet metal discs which have been drawn on, pressed in or attached by welding are known for heat transfer with liquid and gaseous substances. The outer thin discs are not completely in contact with the actual carrier tube, and consequently they are preferably used to control the temperature of air in the highly turbulent flow region. These designs are not pressure-stable and do not have any mixing properties for viscous substances in the laminar flow region. Therefore, tube systems of this type are not suitable for controlling the temperature of viscous and highly viscous liquids. To improve the heat-transfer properties, by way of example, these outer discs and the carrier tube are completely covered with a low-temperature solder in order to increase the size of surfaces which are in contact with product and thereby to increase the heat conduction. The solders used (e.g. zinc, tin) cannot be used in chemical processes with high corrosion specifications, and furthermore the mechanical strength of solders of this type is very low, in particular in the event of high thermal loads.

Furthermore, a temperature-controllable static mixer reactor (DE 2 839 564 A1) is known. This reactor mixes the product flowing through, the mixing internals comprising meandering tubes. This apparatus comprises a housing, the temperature of which can be controlled and in which the mixing internals are replaced by a specially shaped meandering tube bundle.

The tube bundle comprises a plurality of bent, thin tubes running parallel to one another. The ends of the tubes are welded to a flange, from which the heating or cooling agent for controlling the temperature of the product stream is fed in.

The bent tubes running parallel to one another are fitted into the housing, parallel to the direction of flow of the product, as temperature-controlled internals. The meandering tubes are positioned at an alternating angle in the direction of flow of the product and run transversely over the hydraulic diameter of the housing. The tubes arranged in parallel in the bundle cross one another in the axial direction of the housing, in accordance with the known static mixer principle. In this design, the mixing tubes have a round to elliptical flow-facing cross section, and the tubes are inclined at an angle with respect to the product flow, so that there is only a slight distributing diversion or mixing of the product flow whose temperature is to be controlled. Since flow-facing round profiles have a low mixing action, a homogeneous temperature distribution in a high-viscosity product flow cannot be achieved to a sufficient extent over a short distance.

The length of the meandering tube bundle which can be plugged in is always a multiple of the housing hydraulic diameter. On account of their elongated length, the meandering bent tubes have a large heat-transfer surface area. The liquid heat-transfer medium, which releases its energy via the tube bundle around which the product flows, is supplied and discharged through the connecting flange. Particularly when the temperature of viscous substances, which have heat-insulating properties, is being controlled, the large heating surface area cannot be utilized effectively, since the internals do not have a good mixing action.

The bent plug-in tube bundles are susceptible to large pressure gradients. During starting-up operations or in the event of a product blockage caused by highly viscous products, high pressure gradients occur, and consequently the meandering bent heating/cooling tubes are subjected to tensile or compressive loads in the direction of flow of the product and are stretched. The inner heat-transfer internals of the apparatus tend to be deformed in the process, and further control of the temperature of the product is then no longer possible, on account of the absence of diversion of the product. The undesired stretching of the tube bundle is irreparable and may lead to the plant having to be shut down, with high downtime costs.

On account of the ideally elongated length of the individual tube and the small cross section of flow, the temperature-controllable meandering tube bundle has a high pressure loss and a long residence time on the temperature-control side. The combination of the two, i.e. pressure loss and residence time of for example the temperature-control medium in the meandering turns, leads to considerable differences between the inlet temperature and the outlet temperature and reduces the mean temperature difference between the product and the heat transfer media, which is important for heat transfer, significantly. Consequently, the heat-transfer performance of meandering tube bundles of this type is low. In practice, a plurality of tube bundles are often connected in series, and this in turn increases the investment costs, the pressure loss, and the residence time of the substance whose temperature is to be controlled (i.e., the product) and also increases the outlay on assembly.

A uniform and gentle control of the temperature of highly viscous, single-phase or multiphase product flows combined, at the same time, with a short residence time cannot be achieved with the known systems, such as for example static mixers with heatable housings or the temperature-controllable meandering tube bundles.

A need therefore exists for a static mixer whose temperature can be controlled and which has heating passages in the product flow and good mixing properties. Such temperature-controllable static mixers are to have a low pressure loss on the heat-transfer medium side, so that it is possible to reckon on large temperature differences with respect to the temperature-controllable product flow. Furthermore, it is desirable to be able to apply such apparatus concept to large housing hydraulic diameters. An additional improvement with regard to high robustness with respect to mechanical effects, with respect to high pressure gradients and the option to use various thermally conductive and corrosion-resistant materials, in order to satisfy different product demands, would also be advantageous.

There are further demands which must be met with regard to successful adaptation in order to achieve different process-engineering objectives in terms of a low pressure losses on the side which is in contact with product and on the temperature-controlled side, a high mixing capacity, a low residence time spectrum on the product side, a large temperature-control surface area and a high heat transfer capacity. The apparatus is to have significant advantages for use with viscous to highly viscous substances (viscosity 0.001 to 20,000 Pa·s).

The mechanical stability during start-up operations or during assembly is to be increased, so that higher operational reliability can be achieved.

The desired apparatus would advantageously be in the form of a compact heat exchanger which could be installed in production facilities with a low installation outlay and low production costs.

To summarize, it is an object of the invention to provide a static mixer/heat exchanger which avoids the drawbacks of the designs known in the prior art, which allows significantly improved control of the temperature, combined with a smaller apparatus volume, reduces the production costs of the apparatus and has a higher robustness, operational reliability and service life than known heat exchangers.

SUMMARY OF THE INVENTION

According to the invention, these and other objects are achieved by a static mixer/heat exchanger for the treatment of viscous and highly viscous products, comprising at least one housing, the temperature of which optionally can be controlled, for the product to pass through, in which housing at least two tubes whose temperature can be controlled, in particular by passing a heat-transfer medium through them, and which are preferably arranged one behind the other, and which in particular are arranged transversely with respect to the overall direction of flow of the product through the housing, a multiplicity of heat exchanger fins being distributed over the circumference of the tubes, wherein the heat exchanger fins along each tube are oriented in at least two parallel layers, and the fins belonging to the different layers are arranged rotated through an angle $\alpha$ of 45° to 135°, preferably of 70° to 100°, particularly preferably of 85° to 95°, with respect to one another about the axis of the tube, and wherein the fins belonging to the different layers are at an angle $\beta$ of ±10% to ±80% with respect to the overall direction of flow of the product through the housing.

DETAILED DESCRIPTION

In a preferred embodiment, the fins belonging to the different layers are at an angle $\beta$ of ±30° to ±60°, and particularly preferably at an angle $\beta$ of ±40° to ±50°, with respect to the main direction of flow of the product through the housing.

A preferred mixer/heat exchanger is characterized in that for each fin belonging to one layer there is a fin arranged opposite this fin on the tube. In the most simple case, the two fins are then opposite one another at an angle of precisely 180° on the tube.

A preferred mixer/heat exchanger is also characterized in that the fins belonging to the different layers of fins are arranged alternately over the length of the tube. This further improves the mixing action.

In a preferred embodiment, the fins belonging to the different layers of fins are arranged staggered with respect to one another along the tubes.

In an alternative form of the mixer/heat exchanger, to process relatively highly viscous products, the distances between the fins belonging to the different layers are staggered along the tube in order to reduce the pressure loss.

In an alternative embodiment of the mixer/heat exchanger, in order to process relatively highly viscous products, the distances between the fins belonging to the different layers along the tube are selected in such a way that the gap between adjacent fins in the axial direction of the tube is greater than the corresponding fin width.

The gaps increase the product cross section of flow and reduce the pressure loss. If the gaps are smaller than the respective axial fin width, the pressure loss increases and at the same time so does the heat-transfer surface area of the tubes.

In a particular embodiment, the fin width/gap ratio between two fins belonging to two adjacent layers of fins is less than 1, preferably less than 0.7 and particularly preferably less than 0.5, in order to reduce the pressure loss.

A preferred mixer/heat exchanger is likewise characterized in that a plurality of tubes with fins are arranged next to one another in the housing, transversely with respect to the main direction of flow.

The term the main direction of flow of the product is understood to mean the direction parallel to the longitudinal extent of the housing, which follows the overall product flow, i.e. in the case of a tubular housing the direction which is parallel with respect to the center axis of the housing.

In a preferred form of the mixer/heat exchanger, the tubes have temperature-control passages for a liquid heat-transfer medium to pass through, a nozzle having a hydraulic diameter which is reduced compared to the passage, in order to limit the quantitative flow of the temperature-control agent, being arranged in the outflow region of each passage.

The diameter of the nozzle is preferably only half the hydraulic passage diameter of the corresponding tube.

The preferred integrated nozzle at the end of the temperature-control passage, in the outflow region of the tubes, reduces the quantitative flow of the liquid temperature-control medium while maintaining a completely flooded passage. As a result, the uniformity of flow through a large number of finned tubes, which are arranged in parallel, of the mixer/heat exchanger increases.

In a particularly preferred form of the mixer/heat exchanger, the housing of the mixer/heat exchanger has a separate supplying and a separate discharging housing region for the heat-transfer medium, in order to supply the inflow and outflow regions of the temperature-control passages. This results in a forced flow through the finned tubes.

The temperature-controllable mixer/heat exchanger may have a circular (hydraulic) or rectangular cross section, so that the cross-sectional shape of the module can be matched to the process engineering requirements. The mixer has an overall size of length to diameter L/D<10, and preferably, in the case of relatively large diameters, the L/D ratio is <5, and particularly preferably the L/D ratio is <1.

A preferred variant of the mixer/heat exchanger is characterized in that finned tubes, in particular tubes provided with different fin shapes and design variants, are arranged in a plurality of planes one behind the other (in the main direction of flow) in the housing. This multistage design on the one hand allows locally more intensive mixing of the material to be mixed and on the other hand, on account of the different heating surface area of the tubes positioned one behind the other in the direction of flow of the product, allows a temperature gradient to be established along the mixing path.

The outer webs can be made to form defined gaps with respect to one another by suitable selection of the distances "a" (cf. FIG. 13) between the horizontal tubes. By varying the vertical tube spacings "h", it is possible to form gaps between the individual mixing levels, so that the pressure loss is reduced and the mixing elements, which are designed in segments, can be successfully joined to the housing by welding.

To make the mixing effect and temperature control even more intensive, a preferred mixer/heat exchanger is constructed in such a way that the radial extent of the respectively adjacent heat exchanger fins arranged on adjacent tubes overlap each other.

The variation in the tube spacings transversely with respect to the direction of flow of the product or the variation between the spacings in the direction of flow of the product makes it possible to improve the mixing and temperature-control operations combined, at the same time, with a smaller apparatus volume (hold-up). During flow through the mixer/heat exchanger, given a dense arrangement, the temperature-control fins of the tubes arranged next to or behind one another engage in one another. This increases the flow velocity and consequently the temperature-control and mixing capacity.

Furthermore, a preferred mixer/heat exchanger is characterized in that the radial extent of the fins is at least 0.5 times up to 30 times, preferably at least 5 times up to 30 times, preferably at least 5 times up to 15 times, the internal diameter of the associated tube.

Furthermore, a preferred mixer/heat exchanger is characterized in that the radial fins on the tubes are hollow, and the fin cavity is directly connected to the tube interior.

In particular embodiments, the guiding surfaces of the fins are structured in elevated form, so that the heat-exchanging surface area is further increased in size and additional mixing or flow effects occur in particular when low-viscosity substances are passing through.

On account of the heat-conduction properties of the tube material used and of the substance-specific heat transfer coefficient of the product whose temperature is to be controlled, it is now possible to select any desired size for the radial extent of the fins and the resulting larger active heat exchange surface area combined, at the same time, with a reduction in the local pressure loss. A large radial extent of the fins can be achieved if the fins are of hollow design and the fin cavity is directly connected to the passage in the tube. If a high dispersion capacity is required for process reasons, the radial extent of the fins can be selected to be large, so that the fins in different levels overlap or fins belonging to adjacent tubes engage in one another. The tubes with hollow fins can be produced integrally by casting. A welded structure is also possible on account of modem welding processes (laser welding).

Another preferred variant of the mixer/heat exchanger is characterized in that the inner walls of the tubes are contoured in order to increase their surface area, in particular in the form of longitudinal ribs. Analogously to the interior of the temperature-control tube, it is preferable for the outer surfaces of the temperature-control tubes and in particular the fins to be provided with contours, in order to increase the size of the product-side heat-transfer surface.

Alternatively, the mixer/heat exchanger is preferably designed in such a way that the tubes are provided with electrical resistance heating.

If the mixer/heat exchanger is used as a heater having electrical heater cartridges which have been plugged into the tubes, the separately formed supplying and discharging lines for temperature-control agent can be dispensed with, so that the tubes which are directly connected to the surrounding housing can be fitted with heater cartridges on one side.

If liquid heat-transfer medium is used, the temperature range for the mixer/heat exchanger is from about −50° C. to about +300° C. Above 300° C., the mixer/heat exchanger can be operated with electrical heater cartridges, up to temperatures of about 500° C.

To carry out catalyzed processes, it is advantageous to use a further preferred embodiment of the mixer/heat exchanger, which is characterized in that the tubes and/or fins are coated with a catalyst on their surfaces which are in contact with the material to be mixed.

It is preferable for the finned tubes of the mixer/heat exchanger to be of single-part design, for example by producing the tubes together with the fins by means of a casting process or as a forging.

Producing the tubes with fins or the finned tubes by casting or deformation has cost benefits. In particular, the homogeneous microstructure of the material ensures good heat conduction from the temperature-control agent flowing through to the outer surface which is in contact with product and avoids cold bridges. For this reason, in particular metallic, alloyed CrNi materials, Cu compounds, aluminum, titanium, high-alloy nickel steels or precious metals are preferred materials.

The mixing action and heat exchanger function are particularly effective in a preferred mixer/heat exchanger in which the finned tubes are arranged at an angle $\gamma$ of at most +/−15° in the housing, as seen in the transverse direction with respect to the overall direction of flow of the product.

For special mixing tasks, it is advantageous to use a preferred mixer/heat exchanger in which in the housing tubes provided with fins are fitted one behind the other in a plurality of planes in the direction of flow, and the tubes belonging to the planes have differently dimensioned fins compared to the fins of the tubes from adjacent planes.

A preferred mixer/heat exchanger is characterized in that at least two parallel sets of tubes with fins, arranged one behind the other, have different shapes of fins.

A particularly preferred mixer/heat exchanger structure is characterized in that at least one tube with fins in one plane is guided on one side, by means of a tube extension, through the supplying or discharging temperature-control region to outside the housing, and the passage in the finned tube is closed on one side, and at least two radial openings form a connection from the passage in the finned tube to the product space of the mixer/heat exchanger, through which medium flows, in order to carry an additional liquid or gaseous component into the main flow of the material being mixed and to directly mix this component with the material.

Feeding in an additional substance directly via an outwardly extended finned tube allows the mixer/heat exchanger to be used as a reactor. It is firstly possible to meter in a dye or an additive or an entraining agent, in order, for example, to dye viscous products, to effect admixtures or to supply cleaning agents for a subsequent cleaning stage. Another process engineering use becomes possible if, for example, a reaction component is metered into the main flow via the cross section of flow of the mixer/heat exchanger, and as a result a chemical reaction is started or initiated. Any heat generated a result of the start of an exothermic reaction can be dissipated immediately in order to keep the process isothermal.

In particular embodiments of the mixer/heat exchanger, tubes with outer fins or guiding surfaces are arranged above one another in a U-shaped housing, and the two U-shaped housing shells are welded together to form a sealed housing, so that a right-angled cross section of flow is formed for the product whose temperature is to be controlled (FIGS. 2, 2*a*).

A further user-friendly embodiment of the mixer/heat exchanger consists in the possibility of temperature-controlling finned-tube ends each being inserted into separate heater pockets for supplying and discharging the heat transfer medium, being welded in place and being provided on one side with a flange, so that they can be inserted into a matching housing as plug-in temperature-control units.

A further preferred embodiment of the invention comprising plug-in temperature-controls units can be used if the housing of the product-side flow channel has lateral openings in the direction of flow, into which the temperature-control unit can be inserted transversely to the direction of flow, so that the product-side flow cross-section can be completely filled with the temperature-controllable static mixer unit. Several plug-in temperature-controls units, in each case staggered by 90° C. in the main direction of flow, can then be inserted into the product-conveying channel of the housing. This considerably simplifies the assembly and disassembly of the device for cleaning purposes due, for example, to a change in the product to be treated. In this embodiment the temperature-control units which can be plugged in at one side are supplied from one side with the heating medium so that the flow parameters of the heat exchange medium are regulated via a prolonged capillary extending into the temperature-control channel of the temperature-control unit and any further narrowing of the temperature-control channel is not necessary.

The finned tubes positioned one above the other, having the distributor pockets on one side, can be pushed as plug-in units into temperature-controlled housings. In an arrangement of this type, a particularly large heating surface area is located within a small space, so that temperature control which is gentle on the product takes place within a short residence time. A particular advantage for the user is the possibility of cleaning the temperature-controllable mixer unit.

It is preferable for it to be possible for a plurality of mixer/heat exchangers to be arranged one behind the other, if appropriate in combination with known static mixers. The mixer/heat exchangers may be arranged rotated through an angle $\delta$ of 45 to 135°, e.g. of 90°, about the housing center axis with respect to one another.

Connecting a plurality of mixer/heat exchangers in series allows a chemical reaction in a static-mixing reactor to be kept sufficiently homogenized and isothermal.

The mixer/heat exchanger is a high-performance temperature-control apparatus which allows a high heat-transfer capacity to be achieved even with a laminar flow velocity. For this reason, the mixer/heat exchangers according to the invention are preferably suitable for constructing flow reactors with a low level of back-mixing for carrying out exothermic and endothermic processes. Depending on the particular objective, it is possible to distinguish between process-intensive reactor regions, in which a reaction is started and rapid heat exchanges desired, and residence-time regions, which have less of a temperature-regulating action and all that is required is mixing. Residence-time regions of flow reactors may, for example, be temperature-controlled tubes with inserted, known static mixers.

The principal application of the invention is in the field of gentle but rapid temperature control of viscous to highly viscous substance systems. For these applications, in addition to effective temperature control, good and at the same time effective mixing is always required, in order to achieve a constant temperature across the cross section of flow.

The possibility of introducing a further substance directly into the main flow, via the additional, preferred substance feedline, and distributing this further substance, makes it possible to mix in additives or dyes, so that additional mixing sections can be dispensed with in a process engineering plant. Particularly in the case of processes for demonomerization of polymer melts, it is possible for what are known as entraining agents to be metered directly into the melt, and at the same time, on account of the effective temperature control, the polymer is heated gently but within a short time to a higher temperature level without inducing any thermal damage to the product, so that a downstream evaporation step as purification step, for example to remove a relatively low-boiling, undesired component, can be carried out.

A plurality of mixer/heat exchangers which are connected in series can be used to design tubular reactors with little back-mixing. By way of example, it is possible for a reaction component to be distributed uniformly into the reaction chamber (product chamber) via the additional substance feedline of a preferred mixer/heat exchanger. In the case of endothermic reactions, the energy required for the reaction can be supplied directly in the flow path. If heat is evolved during the reaction, the heat of reaction can be dissipated directly if a refrigerant is connected up.

With the above mentioned invention, it is possible to form small, compact high-performance heat exchangers for low-viscosity and high-viscosity, liquid and gaseous substances. The apparatus have a very stable design, can be used with high pressure gradients on account of the stable design, have a large heat-transfer surface area and operate with little back-mixing. Particularly in the case of applications for controlling the temperature of viscous and highly viscous single-phase or multiphase substance systems, the advantages are particularly significant on account of short residence times.

The flow characteristics of very highly viscous substance systems imply a very high pressure loss, and consequently only low flow velocities are economically possible. The person skilled in the art speaks of creeping flows. In this case, the heat exchange between heat-transfer medium and product is particularly poor. In this application, in addition to the large heat-exchanging surface area, an intensive mixing operation is simultaneously required in order to achieve gentle and uniform heating of the product. Given a suitable arrangement of the finned tubes, the temperature of the product is controlled with a very short residence time and a narrow residence time spectrum, so that the mixer/heat exchanger according to the invention can be used to control the temperature in particular of temperature-sensitive substances.

In individual cases, the invention even makes is possible to dispense with a completely temperature-controlled housing, with the result that, inter alia, investment costs are reduced further.

On account of the high design flexibility of the mixer/heat exchangers according to the invention, by combining the tube spacings "a" and "h" with different fin regions, varying the number of the finned tubes next to one another, beneath one another or offset with respect to one another, and varying the tube spacings transversely to or in the main direction of flow of the product, it is possible to satisfy all process engineering and product-specific requirements.

In a particularly advantageous application, the apparatus can be operated with low temperature differences between inlet and outlet of the heat-transfer medium or the coolant, so that a high capacity heat transfer is possible during temperature control and very good utilization of the secondary energies is also possible.

The static mixer/heat exchanger of the present invention makes it possible to produce compact, pressure-resistant and inexpensive heat-transfer apparatus or tubular reactors with little back-mixing. The shape of mixer/heat exchanger units, which can be plugged into corresponding temperature-controlled housings, results in apparatus which are particularly easy to operate and allow simple cleaning.

In particular the application as a tubular reactor with little back-mixing, having an integrated unit for uniformly feeding in a reaction component over the hydraulic cross section of flow of a primary main product stream, offers further possible technical applications which have not hitherto been possible with equipment in accordance with the prior art.

BRIEF DESCRIPTION OF THE DRAWINGS

The invention is explained in more detail below with reference to the figures and by means of examples which, however, do not constitute any limitation to the invention.

In the drawing.

EXAMPLES

Example 1

Figure 1A:
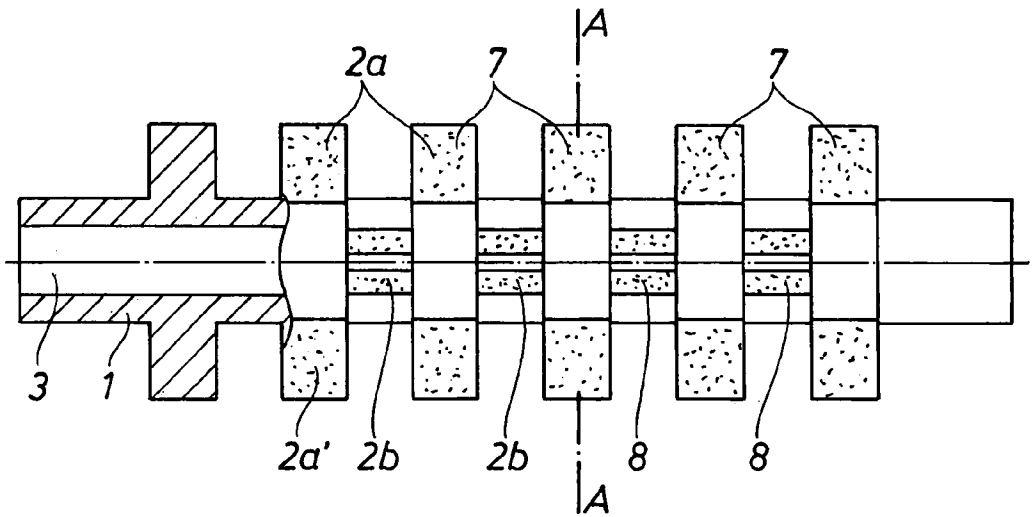
FIG. 1*a* shows a partial cross section and lateral view of the tube 1 with fins 2*a* and 2*b* as shown in FIG. 1.
Figure 1:
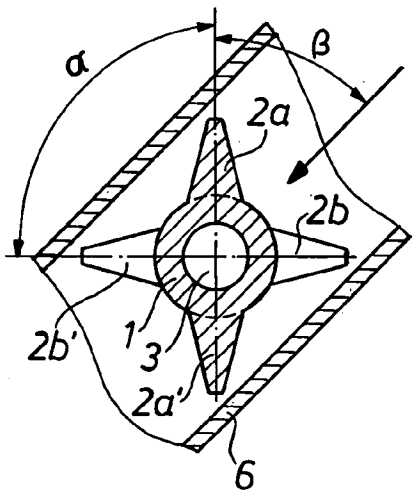
FIG. 1 shows a longitudinal section through the housing 6 of a mixer/heat exchanger according to the invention on line I—I in FIG. 1*a* and the angular offset of the fins with respect to one another and the angular arrangement of the fins with respect to the main direction of flow.

FIG. 1 shows a single-piece tube 1 in a housing 6 through which product flows, which tube, on the outer circumference, has a finned region and two radial mixing fins 2*a*, 2*a*', which are at an angle β+45 or −135° with respect to the main direction of flow (arrow) in a front finned region, illustrated in section, and a rear finned region with two further fins 2*b*, 2*b*'. The width of the finned region is in this case selected in such a way that two fin layers each having two fins 2*a*, 2*a*' and 2*b*, 2*b*' are arranged alternately along the tube axis, radially offset with respect to one another, in the housing 6, and adjoin one another without any gaps in terms of their axial extent (cf. FIG. 1*a*).

The shape or configuration of the fins and the surface condition of the fins may differ. The surface of the fins and of the tube may, for example, be structured by elevated bosses, studs or flutes or grooves, in order to increase the heat-transfer surface area and to produce additional flow effects. It substantially depends on the process engineering objective or specification. FIGS. 3 to 9 show examples in this respect. The fins may be arranged radially symmetric (as in FIGS. 3–5) or asymmetric (FIGS. 7–9) on the outer circumference of the tube 1 and may be at different angles to one another, it also being possible to combine differently shaped fins with one another. The fin shape may deviate from the simple radial shape to the extent that they may additionally be curved as guide vanes; this is particularly advantageous if the concentric regions overlap and it is desired to produce secondary flows.

Figure 3:
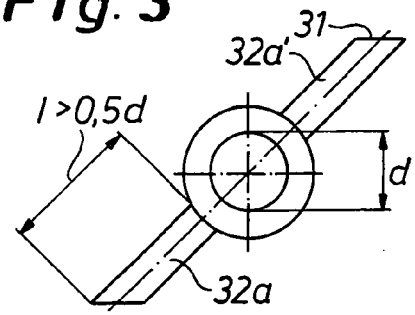
FIGS. 3, 3*a* show a cross section through a variant to a fin pair 2*a* shown in FIG. 1.
Figure 3A:
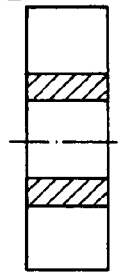

FIGS. 3, 3*a* show a cross section and longitudinal section, respectively, through a tube 1 similar to that shown in FIG. 1, with two fins 32*a*, 32*a*' which have a constant cross-section and have a flattened section 31 at their ends, transversely with respect to the main direction of flow 21.

Figure 4:
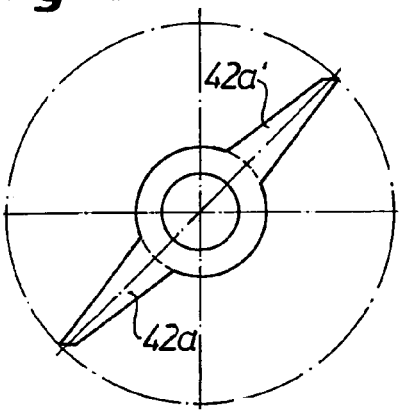
FIGS. 4, 4*a* show a further variant to a fin pair 2*a* shown in FIG. 1.
Figure 4A:
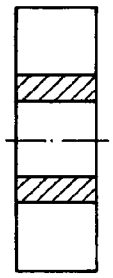

In the variant shown in FIGS. 4, 4*a*, the fins 42*a*, 42*a*' are designed to be narrowed in cross section at the end. According to the variant shown in FIGS. 5, 5*a*, the fins 52*a*, 52*a*' are similar to those shown in FIG. 4, but with a widened base corresponding to the diameter of the tube 1.

Figure 5:
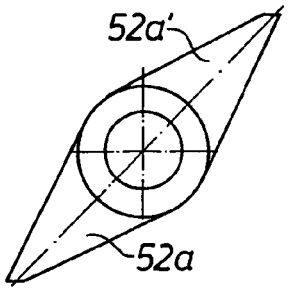
FIGS. 5, 5*a* show a further variant to a flow-optimized fin pair 2*a* shown in FIG. 1.
Figure 5A:
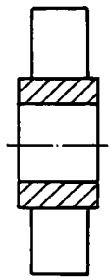
Figure 6:
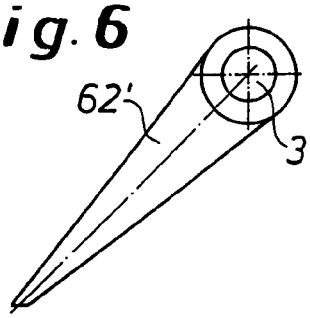
FIGS. 6, 6*a* show a variant to a fin pair 2*a* shown in FIG. 1 with only one fin 62' and an eccentric heating passage 3.
Figure 6A:
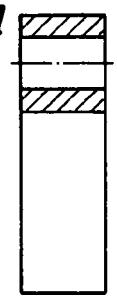

FIG. 6 shows a variant of a finned tube 1 similar to that shown in FIG. 5, but with only one fin 62' in a layer of fins. The embodiment shown in FIG. 7 combines fin shapes shown in FIG. 4 and FIG. 5, in this case with different radial extent of the fins 72, 72'.

Figure 7:
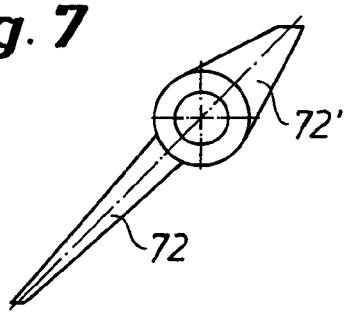
FIGS. 7, 7*a* show a variant to a fin pair 2*a* shown in FIG. 1.
Figure 7A:
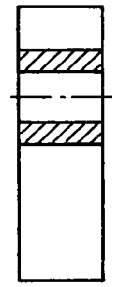
Figure 8:
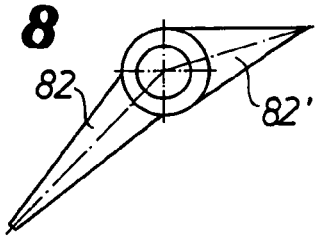
FIGS. 8, 8*a* show a further variant to a fin pair 2*a* shown in FIG. 1.
Figure 8A:
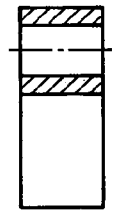

In the embodiment shown in FIG. 8, which is similar to FIG. 7, the two fins 82, 82' are arranged rotated in cross section with respect to one another through an angle of 170° about the tube axis.

Figure 9:
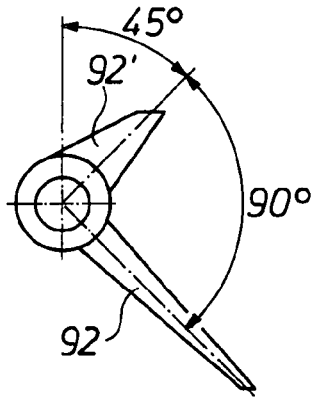
FIGS. 9, 9*a* show a further variant to a fin pair 2*a* shown in FIG. 1.
Figure 9A:
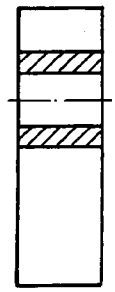

In the variant shown in FIG. 9, the angle offset is 90° between the fins 92 and 92' compared to the arrangement shown in FIG. 7.

The shape and arrangement of the fins makes it possible to enhance the heat-transfer surface area on the side which is in contact with product and also the flow around the tube and therefore also the important mixing operation. Particularly for operations of controlling the temperature of highly viscous media, with a viscosity of greater than 1 Pa·s, a defined arrangement of the fins on the outer circumference of the tube is useful in order, in addition to the heat transfer, also to achieve an effective mixing action. To increase the heating capacity, the inner contour of the finned tubes 1, which is in contact with the temperature-control agent, may likewise be equipped with ribs. As a result, the heating surface area on the heat-or refrigeration-transfer medium side is significantly increased in size.

The tube shape with any desired number of and/or deliberately arranged finned regions on the outer tube diameter can be produced economically by means of a casting process or a forging process; this ensures that there is always sufficient metallic contact between tube and elevated outer contour. In particular cases, the radial fins may be of hollow design, so that the web cavity is directly connected to the temperature-control chamber and constant wall thicknesses are present throughout. Specifications relating to mechanical strength and required compressive strength are satisfied by means of a suitable choice of the wall thickness.

The tubes can be produced from different materials, so that a sufficiently high corrosion resistance is ensured.

The casting process allows economic production of up to only a certain length of tube. Greater lengths of tube have to be produced by connecting a plurality of tube units using a suitable welding process.

Example 2

Figure 2A:
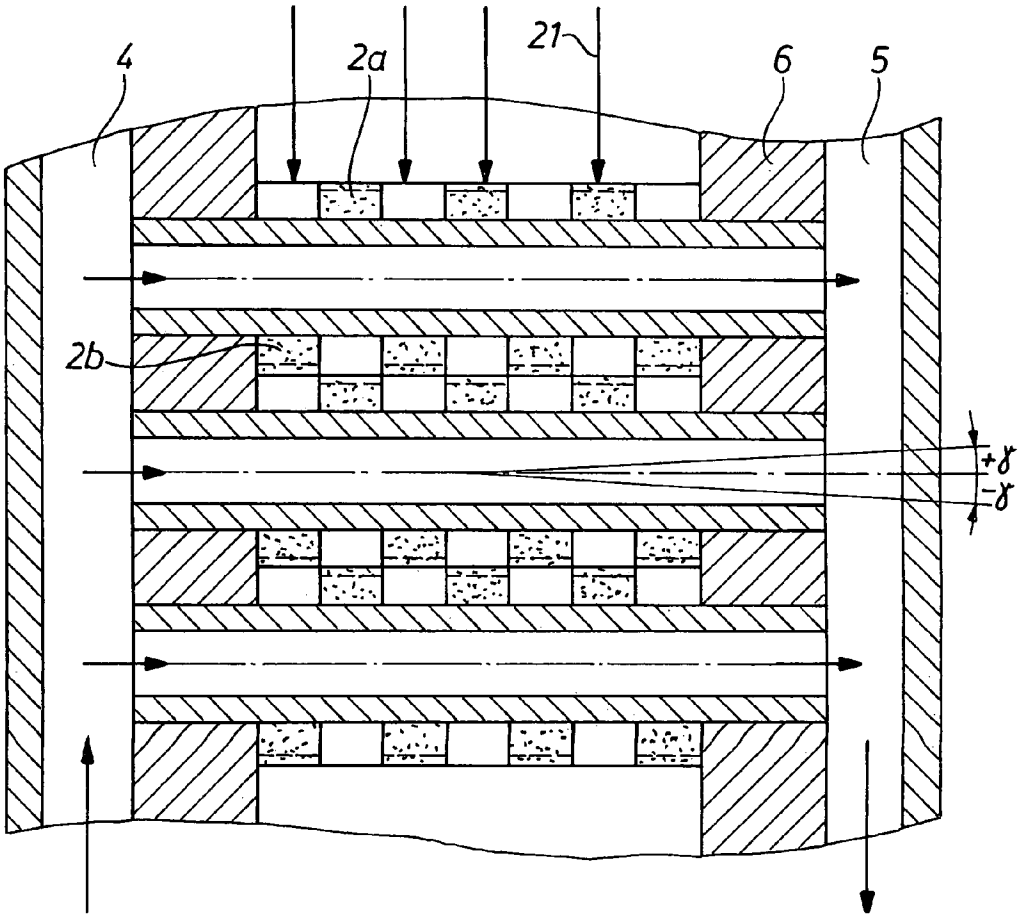
FIG. 2*a* shows the mixer/heat exchanger on line II—II from FIG. 2, having a supplying heat-transfer medium chamber 4 and a discharging heat-transfer medium chamber 5, and the angular range $\gamma$ for the inclined position of the finned tubes in the region of the product flow.
Figure 2:
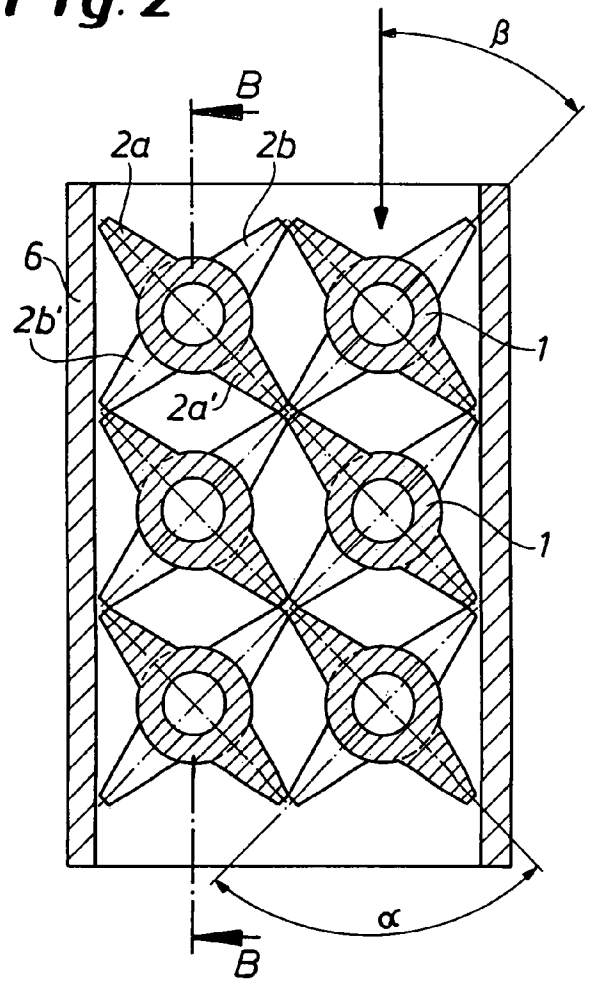
FIG. 2 shows a mixer/heat exchanger with two tubes 1 arranged in parallel in a plane with fins 2*a* and 2*a*' in the region of the product flow, and the angular range $\alpha$ of the fins 2*a* and 2*b* and the angular range $\beta$ of the fins with respect to the main direction of flow.

A further mixer/heat exchanger is represented in longitudinal section in FIG. 2. Six tubes 1 have two parallel layers of fins 2*a* and 2*b*, each having two radially offset fins 2*a*, 2*a*' on the outer circumference of the tubes. One end of the tubes 1 opens into a heat-transfer medium supply chamber 4, and the other to a heat-transfer medium discharge chamber 5 (FIG. 2*a*). The tubes 1 are welded to the supply chamber 4 and the discharge chamber 5. The tubes 1 are at an angle γ of approximately 5° transversely with respect to the main direction of flow 21 of the product. The tubes 1 with the fins are positioned in such a way that the fins are positioned at an angle β of 45° with respect to the incoming product flow 21. The fins 2*a* are at an angle α of 90° with respect to the offset fins 2*b*.

The supply chamber 4 and discharge chamber 5 of the temperature-control agent comprise a pocket or half-tube (not shown) welded to the housing 6.

Example 3

Figure 10:
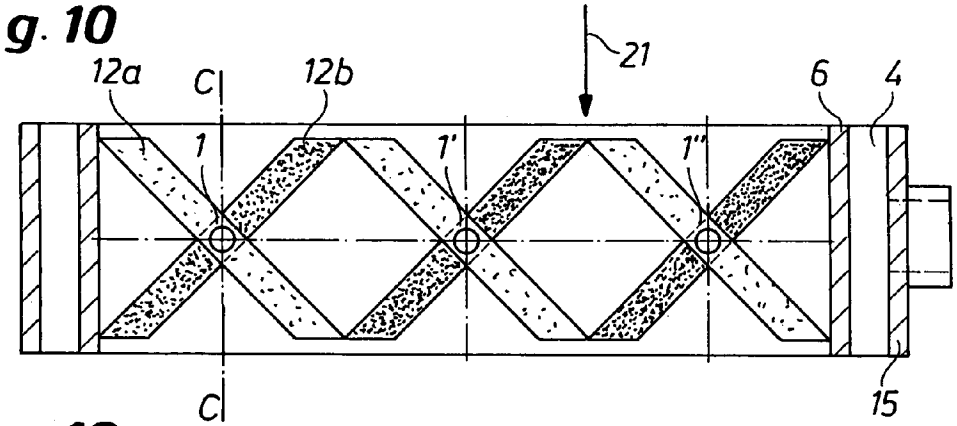
FIG. 10 shows a longitudinal section on line III—III from FIG. 12, through a rectangular mixer/heat exchanger unit with three tubes 1, 1', 1" lying next to one another in a plane and a heat-transfer medium feedline chamber 4 which has been extended around the housing.

FIG. 10 shows a mixer/heat exchanger unit, having a rectangular housing 6 and three finned tubes 1, 1', 1". In terms of their structural shape, the fins 12*a*, 12*b* correspond to the types shown in FIG. 3, and they are arranged in alternating layers over the length of the tubes 1, 1', 1".

Figure 11:
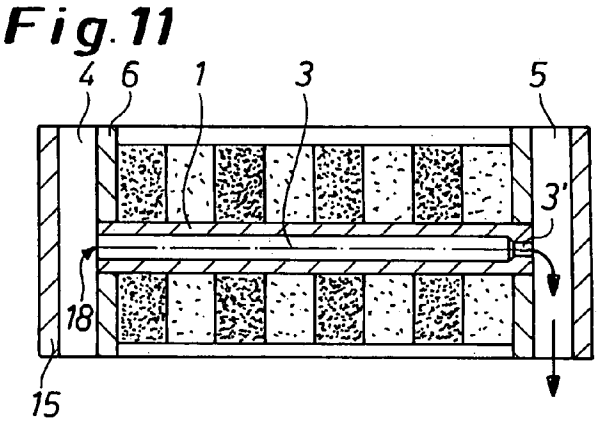
FIG. 11 shows a cross section through a mixer/heat exchanger unit, on line IV—IV from FIG. 10, and integrated nozzle or diaphragm 3' in the outlet region of the heating passage 3.
Figure 12:
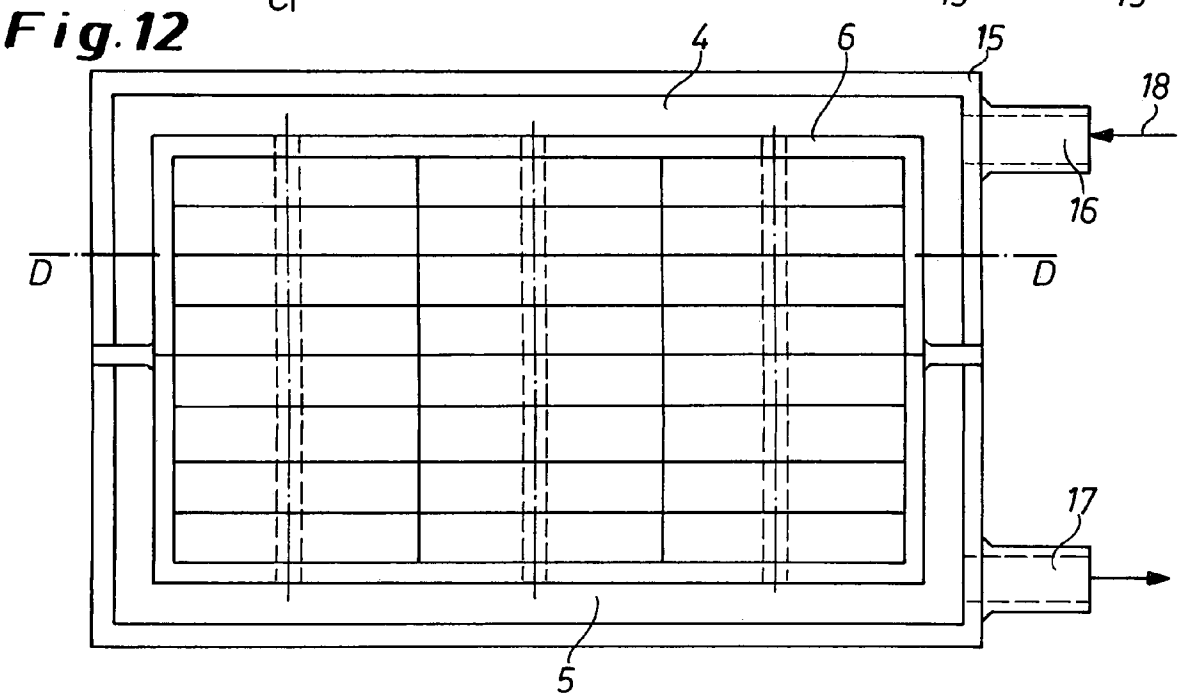
FIG. 12 shows a plan view of a mixer/heat exchanger unit in accordance with FIG. 10, with connections for the heat-transfer medium feed 4 and discharge 5.

In the cross section shown in FIG. 11 on line IV—IV from FIG. 10, it can be seen that two chambers 4, 5, which are connected to a feedline 16 and a discharge line 17 for a liquid heat-transfer medium (cf. FIG. 12), are formed by an outer casing 15. As shown in FIG. 11, in operation the heat-transfer medium 18 flows through the tubes 1, 1', 1". At their one end the tubes 1, 1', 1" have a constriction 3' in the passage 3.

The mixer/heat exchanger (cf. sectional illustration in FIG. 12) has a rectangular product-flow region formed by the housing 6. The further housing 15, which surrounds the housing 6 and is divided by partition fins, forms the chambers 4, 5 for the heat-transfer medium 18. A plurality of mixer/heat exchanger units formed as shown in FIG. 10 are arranged one behind the other in the direction of flow and are connected flush to a product line. The product flows through the units as shown in FIG. 10 from above (direction of flow 21).

A further possible way of supplying and discharging the temperature-control liquid consists in a ring or jacket tube, which once again has two partition fins in order to ensure a separation between the feed and return of the heat-transfer medium (cf. FIG. 14), being fitted around the heat exchanger housing with internal finned tubes and welded in place. In the case of a round heat-transfer medium chamber and housing, the fins of the tubes 1 whose temperature can be controlled are of different lengths in the flow-facing plane of the product.

The fin shape and direction, in combination with the horizontal tube spacings "a" (FIG. 13) or the vertical tube spacings "h" with respect to one another, is able to form an optimum temperature-controllable mixer/heat exchanger geometry, with a large heat-transfer surface area and a high mixing effect. The tubes with the outer fins may have different tube spacings, and can be selected to be so close together that the concentric finned regions overlap one another and the outer mixing fins cross one another (cf. FIG. 13). As a result, it is possible to vary the heat-transfer surface area per unit volume and to reduce the residence time of the product. The tubes in one plane may have different fin shapes and arrangements.

Example 4

Figure 13:
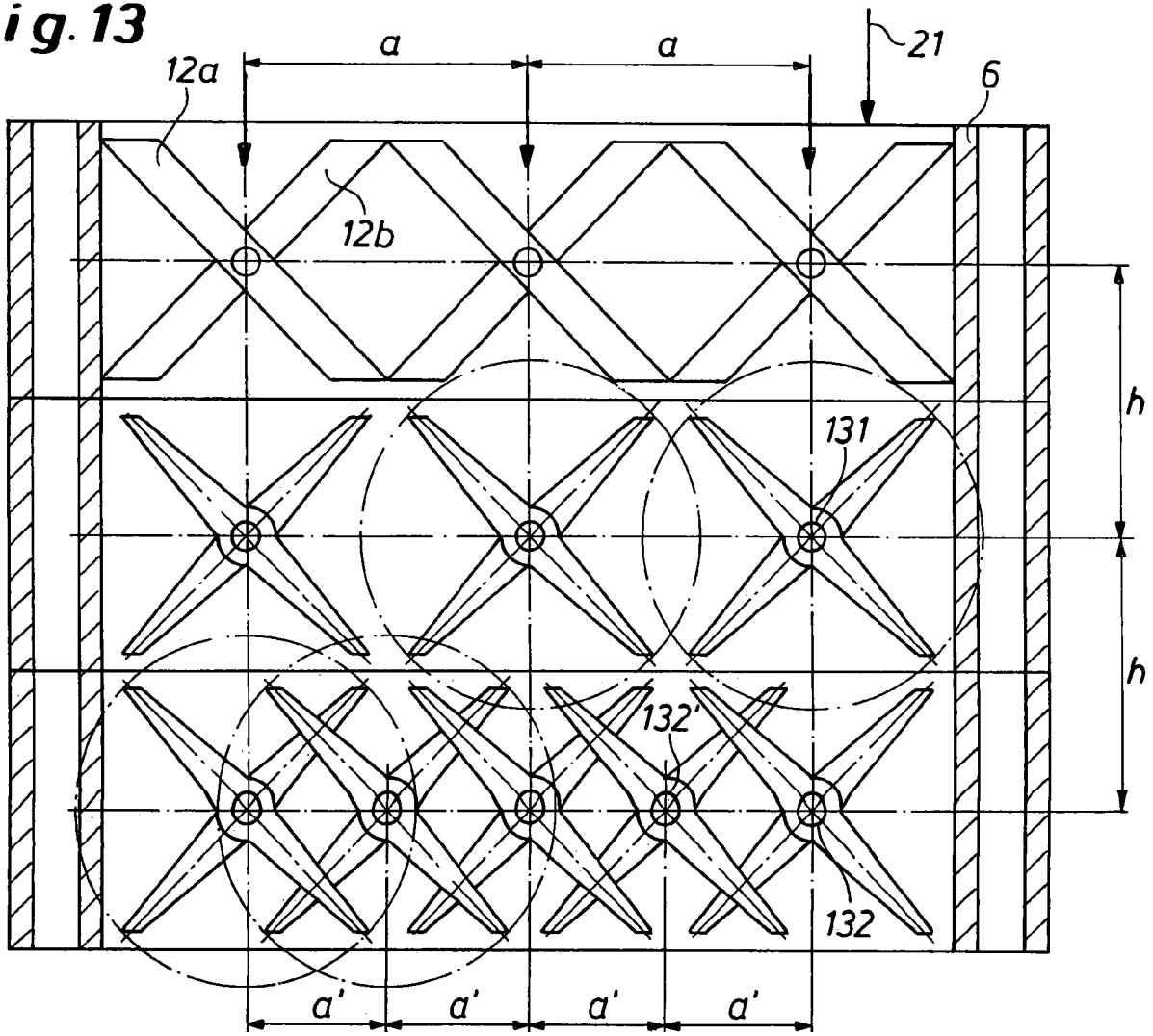
FIG. 13 shows a longitudinal section through a mixer/heat exchanger unit having three rows, arranged one behind the other in the overall direction of flow of the product, of adjacent tubes with differently dimensioned fins and with different tube center-to-center distances "a" and "h", as well as defined gaps with respect to the housing wall and between the individual tube planes in order to reduce dead spaces.

FIG. 13 shows a mixer/heat exchanger arrangement similar to the form shown in FIG. 10, but with two further rows of finned tubes 131, 132, which are arranged one behind the other in the direction of flow of the product 21.

The first row of finned tubes 1, 1', 1" with fins 12*a*, 12*b* corresponds to the form shown in FIG. 10.

In the further rows, the tubes 131, 132 are arranged with the outer fins in such a position that in each case the end fins are at a defined gap from the housing 6, in order to allow flow around the finned tubes to be as complete as possible, in particular with respect to the housing wall 6 (FIG. 13, planes 2 and 3). This gap prevents the formation of dead spaces in the direction of flow, in which products may accumulate, leading to a reduction in the quality of the products on account of prolonged thermal load. At the same time, additional temperature control is effected by the targeted guidance of the product with respect to the temperature-controlled housing.

Example 5

Figure 14:
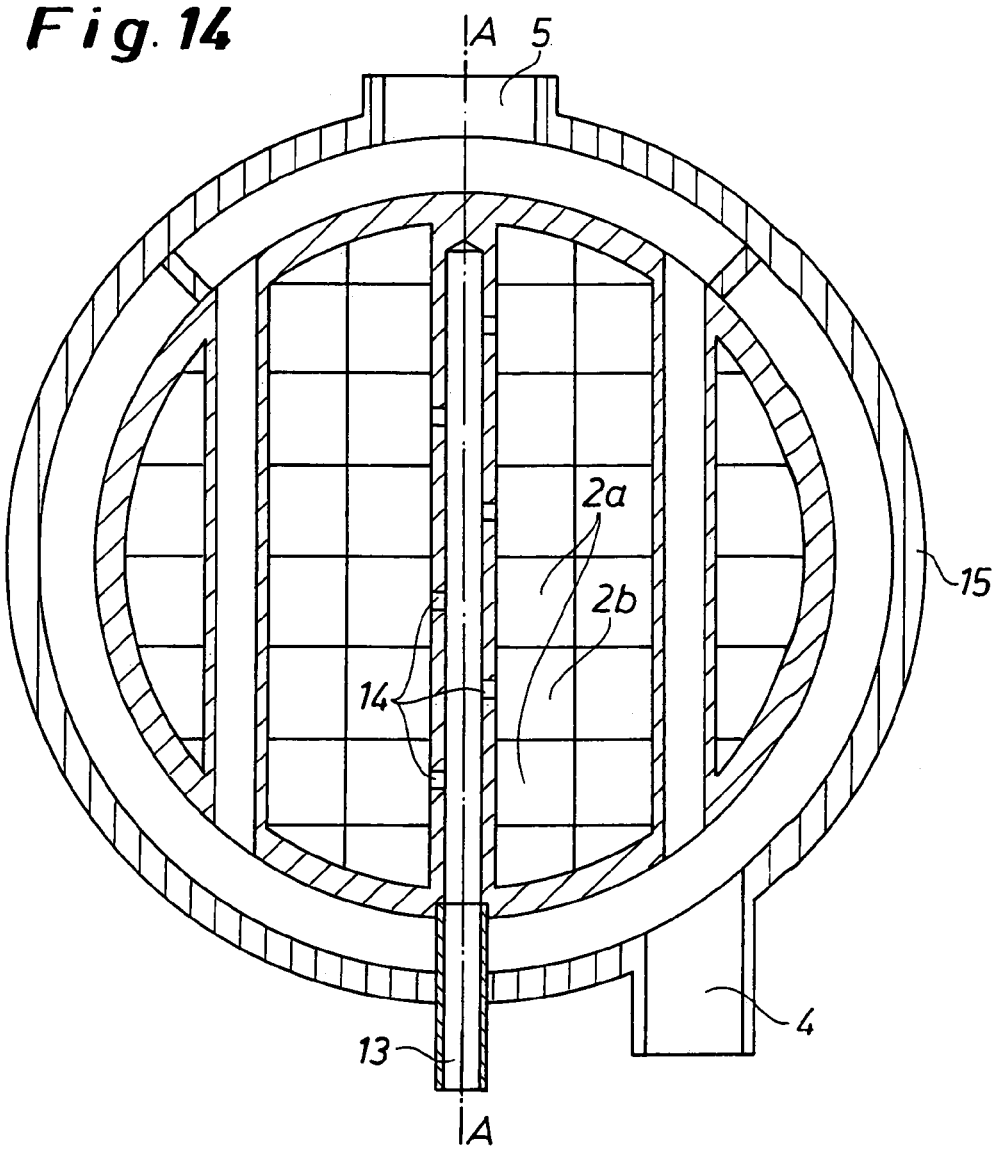
FIG. 14 shows a cross section through a mixer/heat exchanger unit having a separate concentric heat supply region 4 and heat dissipation region 5, and also showing a supplying capillary 13 through the heat-supplying region 4, as an extension of the temperature-control passage on one side, in order to enable an additional substance to be introduced in distributed form into the main flow of product via distributor bores 14.
Figure 14A:
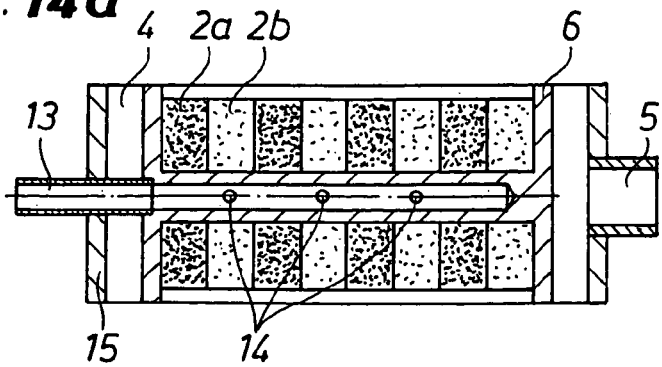
FIG. 14*a* shows a sectional illustration on line V—V from FIG. 14, in particular illustrating the distributor bores 14 for uniform distribution of a supplied substance into the main flow of product.

The temperature-controllable mixer/heat exchangers, according to the variants shown in FIG. 14, can be used to distribute a component which is to be mixed in uniformly in the product. For this application, small inlet openings 14 are introduced in the middle tube 13, in the region of the fins 2*a*, 2*b*, allowing a component which is to be mixed in to be fed via a tube extension (13) through the heating-agent chamber and introduced uniformly over the entire cross section of the flow of the product via the openings 14 which have been made (FIGS. 14, 14*a*).

Figure 15:
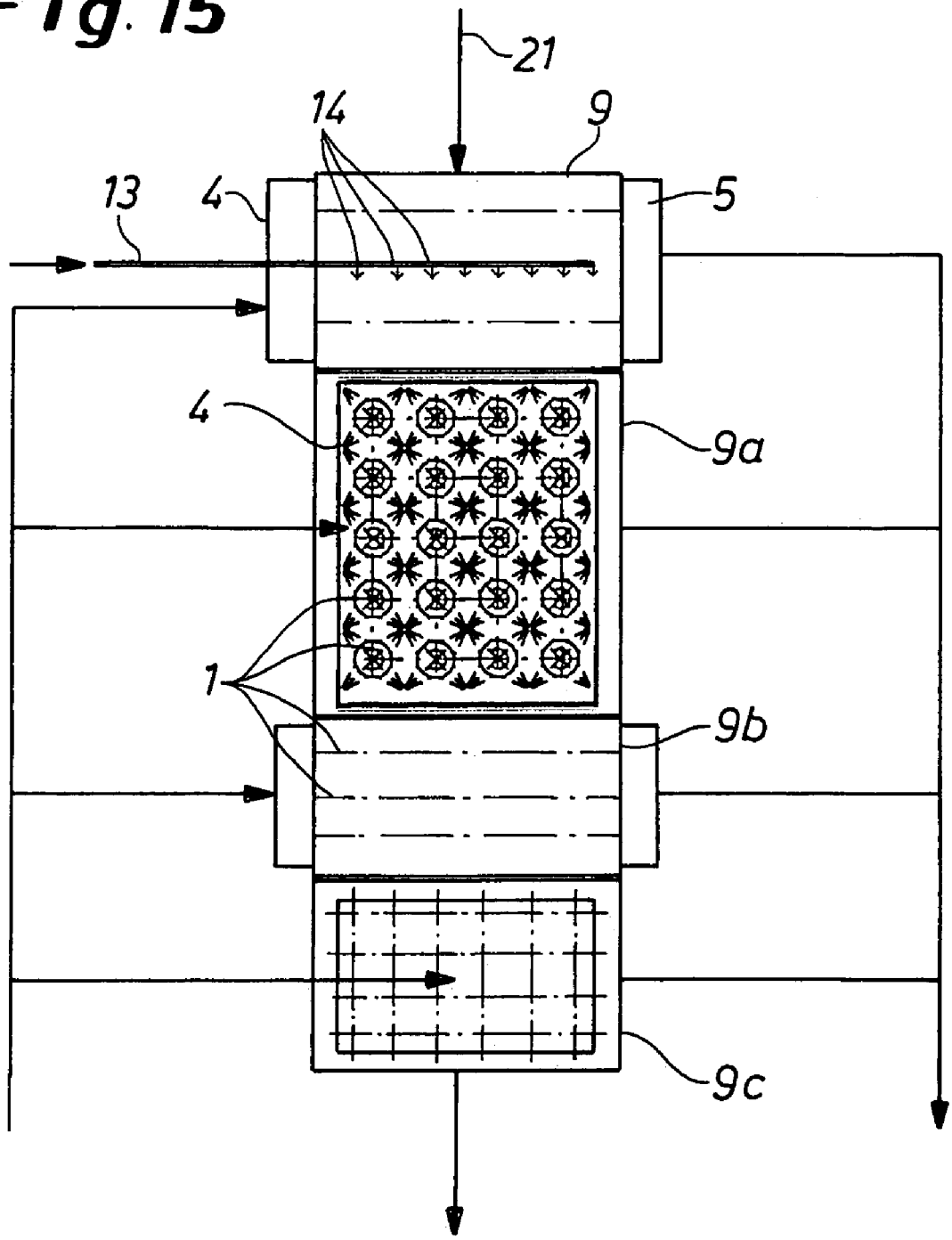
FIG. 15 shows a mixer/heat exchanger reactor which is of modular structure and has a substance introduction via capillary 13 and distribution via bores 14 for supplying a reaction component, the arrangement having four mixer/heat exchanger units (9, 9*a*, 9*b*, 9*c*) with different L/D ratios connected one behind the other, and with the mixer/heat exchanger units arranged rotated through 90° with respect to one another.

A combination of a plurality of mixer/heat exchangers 9, 9*a*, 9*b*, 9*c* to form a flow reactor is shown in sketch form and in section in FIG. 15. In this case, the unit 9*a* has an L/D ratio of 1.5, while the other units of the reactor have an L/D ratio of 0.75. The units are arranged rotationally offset by 90° with respect to one another. The supplying heat-transfer medium chambers 4 and discharging heat-transfer medium chambers 5 of the mixer/heat exchanger units are all connected in parallel with the heat-transfer medium supply. The temperature-control tubes 1 with fins are indicated by dashed lines in the units 9, 9*b* and by the crossing point of the dashed lines in the units 9*a*, 9*c*. It can be seen that the units have different numbers of finned tubes for temperature control in the horizontal plane and in the vertical plane or in the main direction of flow 21, in order to effect a differentiated temperature-control and dispersion capacity in the respective module. In unit 9, the middle tube is only open on one side (in a similar way to the embodiment shown in FIG. 14*a*) and on one side is extended through the temperature-control chamber 4 to outside the mixer/heat exchanger unit 9 by means of a capillary 13. It is then possible for a metering pump, which is not shown in FIG. 15, to be connected up outside of the unit 9, in order, for example, to meter and distribute a further substance (additive, entraining agent, reactants) over the entire cross section of flow of the module or unit. Bores or nozzles 14 along the tube in the product flow are responsible for uniform distribution over the cross section of flow of the unit.

Depending on the volumetric flow of the heat-transfer medium (e.g. hot water, oil, cooling sol), a cross-sectional constriction or a nozzle (diaphragm) is optionally provided in the outlet region of the finned tubes, so that finned tubes which receive flow in parallel are supplied with the same energy density. In the most simple embodiment, the internal diameter 3 of the tube is reduced over a short distance, for example to the internal diameter 3', in the outlet region to the discharging heat-transfer medium chamber, in a similar manner to that which is illustrated in FIG. 11. If steam is used as the energy carrier, it is not necessary to provide this constriction in the internal diameter 3 of the tube 1.

Example 6

Compact Heat Exchanger

Compact heat exchangers have the objective of heating a medium flowing through them to as high a temperature as possible, i.e. to as close as possible to the heating-agent temperature, within a short time, so that there is no thermal damage to the product on account of a brief duration of thermal load. Compact heat exchangers should have smaller apparatus dimensions than known heat exchangers of the same capacity, so that only a small demand for space and therefore low assembly and investment costs result in a process engineering plant. A significant feature for comparing different types of heat exchanger is the heat-transfer capacity, the heat-exchange surface area required and the apparatus volume on the product side. The mixer/heat exchanger according to the invention was compared with an appliance from the prior art (German laid-open specification DE 2 839 564 A1 corresponding to U.S. Pat. No. 4,314,606). The mixer/heat exchanger according to the invention which was tested basically corresponded to the embodiment shown in FIGS. 2 and 2*a*, except that it had four rather than two tubes arranged next to one another transversely with respect to the direction of flow of the product and a total of nine rather than three tube assemblies arranged one behind the other as seen in the direction of flow 21 (cf. FIG. 2*a*).

The product used for the test was a highly viscous substance (silicone oil) with a viscosity of 10 Pa.s, and the product was pumped through the heat exchangers using a gear pump, so that it was possible to gravimetrically determine the mass flow in the outlet region of the corresponding apparatus. The heat exchangers were connected to an electrically heated and regulated thermostat (heating capacity 3 kW) for the test. The heat-transfer medium selected was water, so that the thermostat regulator was set at the thermostat to 90° C. for the inflow temperature. The inlet and outlet temperature of the heat-transfer medium and the product side were measured by means of Pt-100 and recorded and stored on a measured-value recording unit. In addition, pressure sensors recorded the pressures occurring in the inlet and outlet regions of the temperature-control and product side as a result of the flow losses occurring. The apparatus characteristic data of the heat exchangers are compiled in Table 1.

TABLE 1

| Apparatus data | Prior art | Mixer/heat exchanger |
|---|---|---|
| Material | 1.4571 | 1.4571 |
| Hydraulic cross section | 38 × 38 mm | 40 × 43 mm |
| Apparatus length | 310 mm | 158 mm |
| Fin width | Tube 4 × 1 mm | 5 mm |
| Finned regions per tube/fins per region | 8 Tubes in parallel | 8/2 |
| Tube diameter/internal diameter | Tube 4 × 1 mm | 7 mm/5 mm |
| Nozzle diameter in outlet region | — | 2.5 mm |
| Temperature-control surface of the internals | 0.09 $m^2$ | 0.068 $m^2$ |
| Temperature-control surface of the supplying and discharging region (housing component) | 0.00 $m^2$ | 0.012 $m^2$ |

The apparatus data indicate design-related deviations. It can be seen from Table 1 that the mixer/heat exchanger has a shorter overall form and consequently a shorter product-side volume (hold-up). In addition, the mixer/heat exchanger has an active heat-transfer surface area which is smaller by 0.01 $m^2$. For design reasons, a partial region of the housing is always temperature-controlled in the mixer/heat exchanger. The effective total temperature-control surface area has been used for evaluation of the tests. The characteristic data were calculated from the tests carried out, the measured temperatures and pressures, and were compared for the two heat exchangers in Table 2. The heat transferred, the mean heat transfer coefficient and the pressure loss were calculated from the recorded measured values.

The calculated performance data of the heat exchangers for a constant volumetric flow (of silicone oil) of approx. 30 l/h are presented in Table 2.

TABLE 2

| | Prior art | Mixer/heat exchanger |
|---|---|---|
| Heat transfer capacity | 400 W | 520 W |
| Product inlet temperature | 22.6° C. | 22.5° C. |
| Product outlet temperature | 55.2° C. | 67.3° C. |
| Mean heat transfer coefficient | 98 $W/m^2/K$ | 160 $W/m^2/K$ |
| Pressure loss (product side) | 1.5 bar | 1 bar |

The result of the tests confirms the higher performance of the compact mixer/heat exchanger according to the invention. With a constant volumetric flow and a shorter residence time, approx. 120 watts more were transmitted, even though the heat-transfer surface area in contact with product is smaller than in the known heat exchanger. On account of the compact design of the mixer/heat exchanger, it was possible to halve the residence times.

The result of the tests confirms a significant improvement to the heat-transfer capacity with a shorter residence time achieved by means of the mixer/heat exchanger according to the invention.

We claim:

1. Static mixer/heat exchanger comprising a housing (6) having a product flow space for a product to flow through, said product flow space being provided with an inlet and an outlet, at least two tubes (1) which enter the product space and are open at both ends to the exterior of the housing and are adapted to receive heat transfer media within their interior, to heat or cool a product flowing through said product space, a multiplicity of heat exchanger fins (2*a*, 2*b*) distributed over the circumference of the tubes (1), arranged in at least two parallel layers (7, 8) along the tubes (1), and wherein the fins (2*a*) end (2*b*) belonging to adjacent layers (7, 8) are rotated through an angle $\alpha$ of 45° to 135° with respect to one another about the axis of the tubes (1), and wherein the fins (2*a*, 2*b*) are disposed at an angle $\beta$ of ±10° to 80° with respect to the main direction of flow (21) of the product through the housing (6).

2. Mixer/heat exchanger according to claim 1, wherein for each fin (2*a*) or (2*b*) belonging to a layer (7) or (8), there is an opposite fin (2*a*') or (2*b*') to this fin on the tube (1).

3. Mixer/heat exchanger according to claim 1, wherein the fins belonging to the successive layers (7) or (8) are arranged alternately over the length of the tube (1).

4. Mixer/heat exchanger according to claim 1, wherein the fins of adjacent layers (7, 8) are rotationally offset from each other by en angle of from 85 to 95° around the tube axis.

5. Mixer/heat exchanger according to claim 1, wherein a plurality of tubes (1, 1') having fins (2*a*, 2*b*) are arranged next to one another, transversely with respect to the direction to be taken.

6. Mixer/heat exchanger according to claim 1, wherein the housing (6) has feedlines (4) and discharge lines (5) for a heat-transfer medium, which lines are respectively connected to inlets and outlets of the tubes.

7. Mixer/heat exchanger according to claim 1, wherein the tubes (1, 1') which are provided with fins (2*a*, 2*b*) are arranged one behind the other in a plurality of planes in the housing (6).

8. Mixer/heat exchanger according to claim 1, wherein fins (2*a*, 2*b*) arranged on adjacent tubes (132, 132') overlap each other.

9. Mixer/heat exchanger according to claim 1, wherein the fins (28, 2*a*, 2*b*) of successive layers of fins (7, 8) are staggered with respect to one another along the tubes (1, 1', 1").

10. Mixer(heat exchanger according to claim 1, wherein the radial extent of the fins (2*a*, 2*b*) on a tube amounts to at least 0.5 times the internal diameter of the tube (1).

11. Mixer/heat exchanger according to claim 1, wherein the inside wall of the tubes (1, 1', 1") are contoured to increase their surface area.

12. Mixer/heat exchanger of claim 11, wherein said inside walls are contoured in the form of longitudinal ribs.

13. Mixer/heat exchanger according to claim 1, wherein some of the fins (2, 2*a*', 2*b*, 2*b*') of the tubes (1) are hollow, and the hollow space therein is in communication with the interior of the tube (1).

14. Mixer/heat exchanger according to claim 1, wherein the tubes (1, 1', 1") are provided with a resistance heating element or an electrical cooling element.

15. Mixer/heat exchanger according to claim 1, wherein the tubes (1, 1', 1") or the fins (2*a*, 2*b*), or both the tubes and the fins are coated with a catalyst.

16. Mixer/heat exchanger according to claim 1, wherein the tubes (1, 1', 1") are arranged at an angle $\gamma$ of at most +/−15° in the housing (6), as seen in the transverse direction with respect to the overall flow direction through the housing from the product inlet to the product outlet.

17. Mixer/heat exchanger according to claim 1, wherein the tubes (1, 1*a*) which are provided with fins (2*a*, 2*b*) are arranged one behind the other in the overall flow direction through the housing, from the product inlet to the product outlet, in a plurality of planes in the housing (6), and the tubes (1) belonging to adjacent planes have differently dimensioned fins (2*a*, 2*b*) than each other.

18. Mixer/heat exchanger according to claim 1, wherein the mixer/heat exchanger has at least one substance-introduction tube, which is arranged parallel to the other tubes (1), is provided with fins (2*a*, 2*b*) and has a plurality of openings (14) leading to the interior of the housing (6).

19. Mixer/heat exchanger according to claim 1, wherein the tubes comprise an interior nozzle (3') of reduced diameter compared to the inside diameter of the tubes, said nozzle being disposed approximate the discharge end of the tube.

20. A method for controlling the temperature of viscous substance systems having a viscosity of from 0.001 to 20,000 pa·s, which comprises passing said substance systems through the mixer/heat exchanger of claim 1, and heating or cooling said substance systems by heat transfer through the tubes of said mixer/heat exchanger.

21. The mixer/heat exchanger of claim 1, wherein said angle $\alpha$ is 70° to 110°.

* * * * *